US006472019B1

(12) United States Patent
Yamaguchi et al.

(10) Patent No.: US 6,472,019 B1
(45) Date of Patent: Oct. 29, 2002

(54) WATER- AND OIL-REPELLENT TREATMENT OF TEXTILE

(75) Inventors: Fumihiko Yamaguchi, Settsu (JP); Ikuo Yamamoto, Settsu (JP); Kayo Kusumi, Settsu (JP)

(73) Assignee: Daikin Industries, Inc., Osaka (JP)

( * ) Notice: Subject to any disclaimer, the term of this patent is extended or adjusted under 35 U.S.C. 154(b) by 0 days.

(21) Appl. No.: 10/094,624

(22) Filed: Mar. 12, 2002

(30) Foreign Application Priority Data

Mar. 13, 2001 (JP) ..... 2001-070523

(51) Int. Cl.[7] ..... B05D 3/02; B05D 3/04
(52) U.S. Cl. ..... 427/354; 427/377; 427/393.4
(58) Field of Search ..... 427/377, 354, 427/393.4

(56) References Cited

U.S. PATENT DOCUMENTS

| | | | | |
|---|---|---|---|---|
| 4,937,123 A | | 6/1990 | Chang et al. | |
| 5,073,442 A | | 12/1991 | Knowlton et al. | |
| 5,516,337 A | | 5/1996 | Nguyen | |
| 5,520,962 A | | 5/1996 | Jones, Jr. | |
| 6,013,732 A | * | 1/2000 | Yamana et al. | 525/123 |

FOREIGN PATENT DOCUMENTS

| | | | |
|---|---|---|---|
| JP | 1-280076 | | 11/1989 |
| JP | 09-003440 | * | 1/1997 |
| JP | 2001-279578 | * | 10/2001 |
| WO | WO98/50619 A1 | | 12/1998 |
| WO | WO 99/43725 | * | 9/1999 |
| WO | WO 2001/81672 | * | 11/2001 |

* cited by examiner

*Primary Examiner*—Erma Cameron
(74) *Attorney, Agent, or Firm*—Sughrue Mion, PLLC

(57) ABSTRACT

Excellent water repellency, Oil repellency, stain block property and yellowing-resistance are imparted to a textile by a method of preparing a treated textile has the steps of (1) preparing a treatment liquid containing a water- and oil-repellent agent and a stain blocking agent, (2) bringing a pH of the treatment liquid to at most 7, (3) applying the treatment liquid to the textile, (4) treating the textile with steam, and (5) washing the textile with water and dehydrating the textile. The treatment liquid contains a sulfated fatty acid compound.

13 Claims, No Drawings

WATER- AND OIL-REPELLENT TREATMENT OF TEXTILE

FIELD OF THE INVENTION

The present invention relates to a treatment for imparting excellent water repellency, oil repellency, stain block property and yellowing-resistance to a textile. A method of the present invention is particularly useful for carpet.

BACKGROUND OF THE INVENTION

Hitherto, various treatment methods have been proposed in order to impart water repellency, oil repellency and soil releasability to a textile such as a carpet. For example, a process of treating a textile comprising decreasing a pH of a treatment liquid, applying the treatment liquid to the textile, thermally treating the textile with steam, washing the textile with water, and dehydrating the textile (hereinafter, sometimes referred to as "Exhaust process") is proposed.

A method comprising the Exhaust process is proposed in U.S. Pat. Nos. 5,073,442, 5,520,962 and 5,516,337, and International Publication WO 98/50619.

U.S. Pat. No. 5,073,442 discloses a method of treating a textile, comprising conducting an Exhaust process by using a water- and oil-repellent agent comprising a fluorine-containing compound, a formaldehyde condensation product and an acrylic polymer. U.S. Pat. No. 5,520,962 discloses a method of treating a carpet, comprising conducting an Exhaust process by using a fluorine-containing compound and a polymeric binder. U.S. Pat. No. 5,516,337 discloses a method of treating a textile, comprising conducting an Exhaust process by using a fluorine-containing water- and oil-repellent agent and a metal compound such as aluminum sulfate. International Publication WO 98/50619 discloses a method of treating a carpet, comprising conducting an Exhaust process by using a fluorine-containing water- and oil-repellent agent and a salt such as a magnesium salt.

Sufficient water repellency, oil repellency, stain block property and yellowing-resistance cannot be obtained by conducting the Exhaust process in accordance with these methods.

SUMMARY OF THE INVENTION

An object of the present invention is to give a textile excellent in water repellency, oil repellency, stain block property and yellowing-resistance, when an Exhaust process is used.

The present invention provides a method of preparing a treated textile, comprising steps of: (1) preparing a treatment liquid comprising a water- and oil-repellent agent and a stain blocking agent, (2) adjusting pH of the treatment liquid to at most 7, (3) applying the treatment liquid to the textile, (4) treating the textile with steam, and (5) washing the textile with water and dehydrating the textile, wherein the water- and oil-repellent agent comprises at least one fluorine-containing compound selected from the group consisting of a fluorine-containing polymer and a fluorine-containing low molecular weight compound, and the treatment liquid contains a sulfated fatty acid compound.

The present invention also provides a textile prepared by the above-mentioned method, and a treatment liquid used in the above-mentioned method.

The procedure used in the present invention is an Exhaust process which comprises decreasing the pH of the treatment liquid comprising the fluorine-containing compound and stain blocking agent, applying the treatment liquid to the textile, washing the textile with water, and dehydrating the textile.

DETAILED DESCRIPTION OF THE INVENTION

In the step (1) of the method of the present invention, the treatment liquid comprising the water- and oil-repellent agent and the stain blocking agent, which is applied to the textile, is prepared. The treatment liquid comprises the sulfated fatty acid compound, for example, a sulfated castor oil. The treatment liquid may be in the form of a solution or an emulsion, particularly an aqueous emulsion.

The water- and oil-repellent agent is generally a fluorine-containing compound. The fluorine-containing compound is a fluorine-containing polymer and/or a fluorine-containing low molecular weight compound.

The fluorine-containing polymer may be a polymer comprising a repeat unit derived from a fluoroalkyl group-containing monomer such as a fluoroalkyl group-containing (meth)acrylate, a fluoroalkyl group-containing maleate or fumarate, or a fluoroalkyl group-containing urethane.

The fluoroalkyl group-containing (meth)acrylate ester may be of the formula:

$$Rf\text{-}A\text{-}OCOCR^{11}{=}CH_2$$

wherein Rf is a fluoroalkyl group having 3 to 21 carbon atoms, $R^{11}$ is a hydrogen atom or a methyl group, and A is a divalent organic group.

In the above formula, A may be a linear or branched alkylene group having 1 to 20 carbon atoms, a $—SO_2N(R^{21})R^{22}—$ group or a $—CH_2CH(OR^{23})CH_2—$ group ($R^{21}$ is an alkyl group having 1 to 10 carbon atoms, $R^{22}$ is a linear or branched alkylene group having 1 to 10 carbon atoms, and $R^{23}$ is a hydrogen atom or an acyl group having 1 to 10 carbon atoms).

Examples of the fluoroalkyl group-containing (meth) acrylate are as follows:

$$Rf—SO_2—\overset{\overset{\displaystyle R^1}{|}}{N}R^2OCOCR^3{=}CH_2 \quad (1)$$

$$Rf\text{-}(CH_2)_nOCOCR^3{=}CH_2 \quad (2)$$

$$Rf—\overset{\overset{\displaystyle R^1}{|}}{C}ONR^2OCOCR^3{=}CH_2 \quad (3)$$

$$Rf—CH_2\overset{\overset{\displaystyle OH}{|}}{C}HCH_2OCOCR^3{=}CH_2 \quad (4)$$

$$Rf—CH_2\overset{\overset{\displaystyle OCOR^3}{|}}{C}HCH_2OCOCR^3{=}CH_2 \quad (5)$$

$$Rf\text{-}O—Ar—CH_2OCOCR^3{=}CH_2 \quad (6)$$

wherein Rf is a fluoroalkyl group having 3 to 21 carbon atoms, $R^1$ is a hydrogen atom or an alkyl group having 1 to 10 carbon atoms, $R^2$ is an alkylene group having 1 to 10 carbon atoms, $R^3$ is a hydrogen atom or a methyl group, and Ar is arylene group optionally having a substituent, and n is an integer of 1 to 10.

Specific examples of the fluoroalkyl group-containing (meth)acrylate are as follows:

$CF_3(CF_2)_7(CH_2)_{10}OCOCH{=}CH_2$ $CF_3(CF_2)_7(CH_2)_{10}OCOC\ (CH_3){=}CH_2$ $CF_3(CF_2)_6CH_2OCOCH{=}CH_2$ $CF_3(CF_2)_8CH_2OCOC\ (CH_3){=}CH_2$ $(CF_3)_2CF\ (CF_2)_6(CH_2)_2OCOCH{=}CH_2$ $(CF_3)_2CF(CF_2)_8(CH_2)_2OCOCH{=}CH_2$ $(CF_3)_2CF(CF_2)_{10}(CH_2)_2OCOCH{=}CH_2$ $(CF_3)_2CF(CF_2)_6(CH_2)_2OCOC(CH_3){=}CH_2$ $(CF_3)_2CF(CF_2)_8(CH_2)_2OCOC(CH_3){=}CH_2$ $(CF_3)_2CF(CF_2)_{10}(CH_2)_2OCOC(CH_3){=}CH_2$ $CF_3CF_2(CF_2)_6(CH_2)_2OCOCH{=}CH_2$ $CF_3CF_2(CF_2)_8(CH_2)_2OCOCH{=}CH_2$ $CF_3CF_2(CF_2)_{10}(CH_2)_2OCOCH{=}CH_2$ $CF_3CF_2(CF_2)_6(CH_2)_2OCOC(CH_3){=}CH_2$ $CF_3CF_2(CF_2)_8(CH_2)_2OCOC(CH_3){=}CH_2$ $CF_3CF_2(CF_2)_{10}(CH_2)_2OCOC(CH_3){=}CH_2$ $CF_3(CF_2)_7SO_2N(CH_3)\ (CH_2)_2OCOCH{=}CH_2$ $CF_3\ (CF_2)_7SO_2N(C_2H_5)\ (CH_2)_2OCOCH{=}CH_2$ $(CF_3)_2CF(CF_2)_8CH_2CH(OCOCH_3)CH_2OCOC(CH_3){=}CH_2$ $(CF_3)_2CF(CF_2)_6CH_2CH(OH)CH_2OCOCH{=}CH_2$

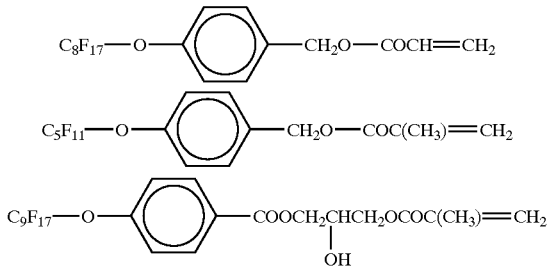

A fluoroalkyl group-containing urethane monomer deriving the fluorine-containing polymer can be prepared by reacting:

(a) a compound having at least two isocyanate groups, (b) a compound having one carbon-carbon double bond and at least one hydroxyl group or amino group, and (c) a fluorine-containing compound one hydroxyl group or amino group.

Examples of the compound (a) include the followings:

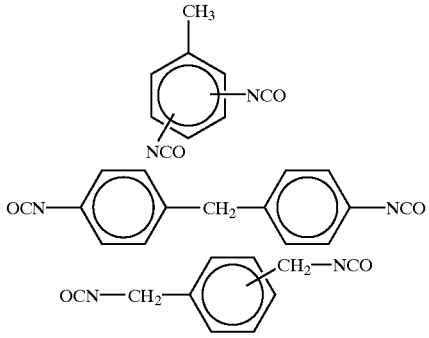

-continued

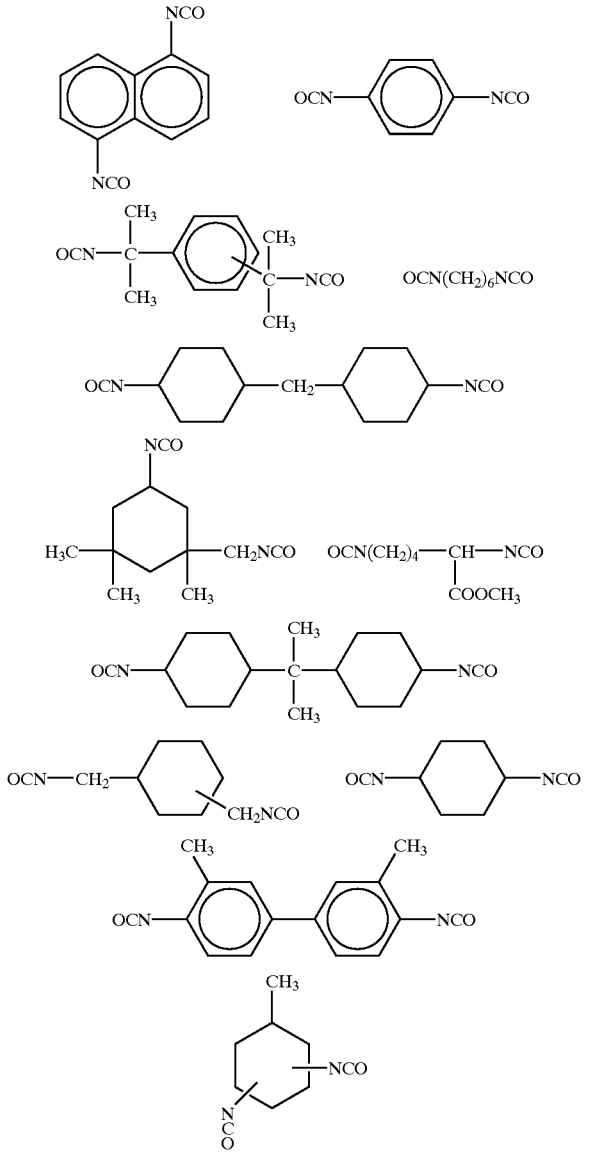

The compound (a) is preferably a diisocyanate. However, a triisocyanate and a polyisocyanate can be used for the reaction.

For example, a trimer of diisocyanate, polymeric MDI (diphenylmethane diisocyanate) and an adduct of diisocyanate with a polyhydric alcohol such as trimethylol propane, trimethylol ethane and glycerol can be also used for the reaction.

Examples of the triisocyanate and the polyisocyanate are as follows:

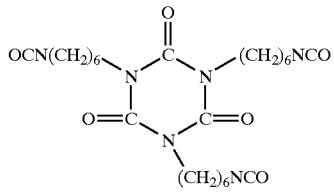

-continued

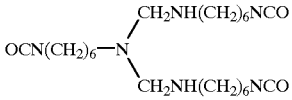

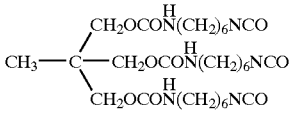

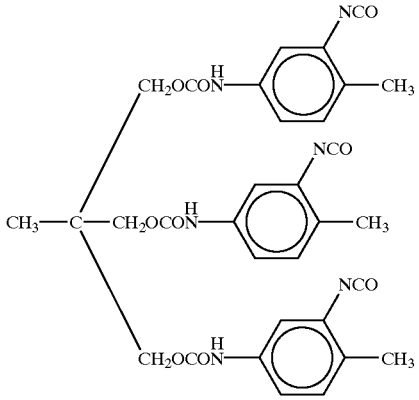

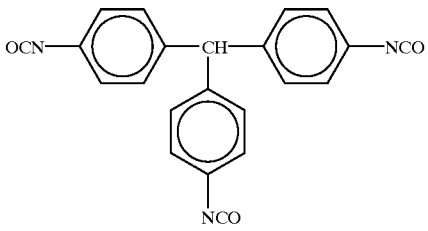

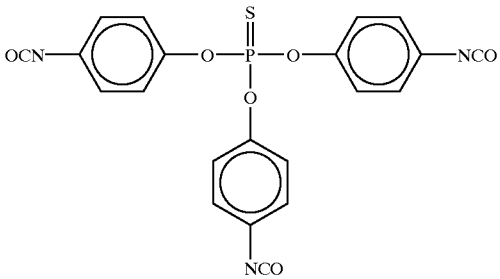

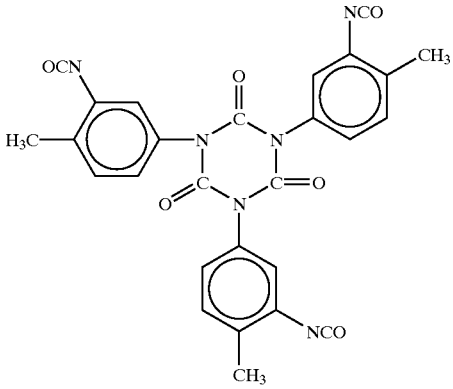

The compound (b) may be, for example, a compound of each of the formulas:

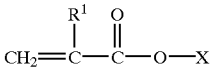

-continued

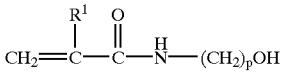

$CH_2{=}CH{-}CH_2{-}OH$ $CH_2{=}CH{-}CH_2{-}NH_2$

In the formula, $R^1$ is a hydrogen atom or a methyl group. X is as follows:

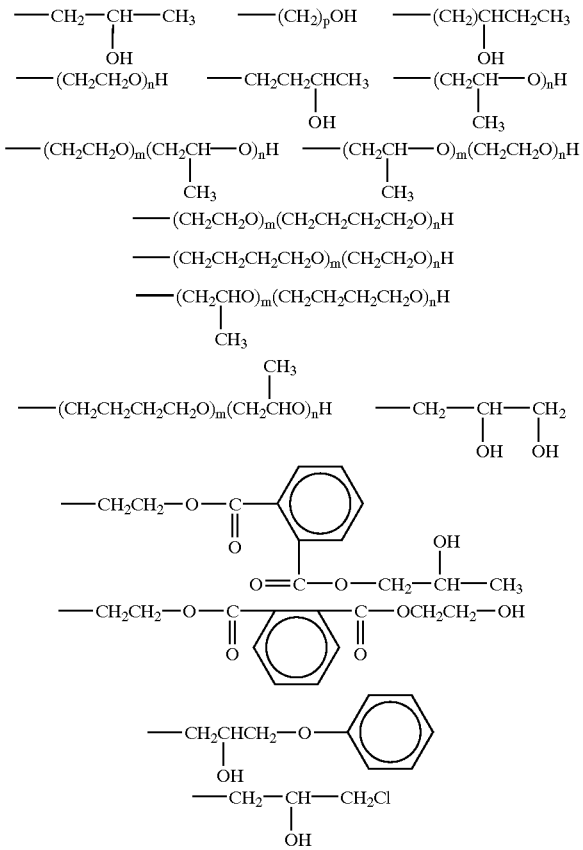

wherein m and n is a number of 1 to 300.

The compound (c) may be a compound of the formula:

$R_f$-$R^2$-OH, or $R_f$-$R^2$-$NH_2$ wherein $R_f$ is a fluoroalkyl group having 1 to 22 carbon atoms, and $R^2$ is an alkylene group having 1 to 10 carbon atoms and may have a heteroatom.

Examples of the compound (c) may be the followings:

$CF_3CH_2OH$ $F(CF_2)_8CH_2CH_2OH$ $F(CF_2)_6(CH_2)_6OH$

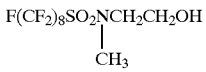

$F(CF_2)_3CH2NH_2$ $F(CF2)_7CH_2NH_2$

The compounds (a), (b) and (c) may be reacted such that when the compound (a) is a diisocyanate, both the compounds (b) and (c) are in amounts of 1 mol based on 1 mol of the compound (a); when the compound (a) is a triisocyanate, the compound (b) is in an amount of 1 mol and the compound (c) is in an amount of 2 mol based on 1 mol of the compound (a).

Examples of the water- and oil-repellent agent used in the present invention include:

(A) a fluorine-containing polymer comprising a repeat unit derived from vinyl chloride and/or vinylidene chloride, and (B) a fluorine-containing polymer free from a repeat unit derived from vinyl chloride and/or vinylidene chloride.

The fluorine-containing polymers (A) and (B) may be a polymer derived from a fluorine-containing monomer such as a fluoroalkyl group-containing (meth)acrylate, a fluoroalkyl group-containing maleate or fumarate, and a fluoroalkyl group-containing urethane.

The fluorine-containing polymer (A) may be, for example, a polymer comprising:

(A-I) a repeat unit derived from a monomer having a fluoroalkyl group, and (A-II) a repeat unit derived from vinyl chloride and/or vinylidene chloride. Example of the fluorine-containing polymer (A) may be a copolymer comprising:

(A-I) a repeat unit derived from a monomer having a fluoroalkyl group, (A-II) a repeat unit derived from vinyl chloride and/or vinylidene chloride, (A-III) a repeat unit derived from a fluorine-free monomer, and (A-IV) a repeat unit derived from a crosslinkable monomer.

The fluorine-containing polymer (B) may be, for example, a copolymer which comprises (B-I) a repeat unit derived from a monomer having a fluoroalkyl group, and which does not comprise a repeat unit derived from vinyl chloride and/or vinylidene chloride. Example of the fluorine-containing polymer (B) may be a copolymer which comprises:

(B-I) a repeat unit derived from a monomer having a fluoroalkyl group, (B-II) a repeat unit derived from a fluorine-free monomer, and (B-III) a repeat unit derived from a crosslinkable monomer, and which does not comprise a repeat unit derived from vinyl chloride and/or vinylidene chloride.

The repeat units (A-I) and (B-1) are preferably a repeat unit derived from a (meth)acrylate ester having a fluoroalkyl group.

The repeat units (A-III) and (B-II) are preferably derived from a fluorine-free vinyl monomer. Non-limiting examples of preferable monomer constituting the repeat units (A-III) and (B-II) include, for example, ethylene, vinyl acetate, acrylonitrile, styrene, alkyl (meth)acrylate, polyethyleneglycol (meth)acrylate, polypropyleneglycol (meth)acrylate, methoxypolyethylene-glycol (meth)acrylate, methoxypolypropyleneglycol (meth)acrylate, vinyl alkyl ether and isoprene.

The monomer constituting the repeat units (A-III) and (B-II) may be a (meth)acrylate ester having an alkyl group. The number of carbon atoms of the alkyl group may be from 1 to 30, for example, from 6 to 30, e.g., from 10 to 30. For example, the monomer constituting the repeat units (A-III) and (B-II) may be acrylates of the general formula:

$$CH_2{=}CA^1COOA^2$$

wherein $A^1$ is a hydrogen atom or a methyl group, and $A^2$ is an alkyl group of $C_nH_{2n+1}$ (n=1 to 30). The copolymerization with this monomer can optionally improve various properties such as water- and oil-repellency and soil releasability; cleaning durability, washing durability and abrasion resistance of said repellency and releasability; solubility in solvent; hardness; and feeling.

The crosslinkable monomer constituting the repeat units (A-IV) and (B-III) may be a fluorine-free vinyl monomer having at least two reactive groups. The crosslinkable monomer may be a compound having at least two carbon-carbon double bonds, or a compound having at least one carbon-carbon double bond and at least one reactive group.

Examples of the crosslinkable monomer include diacetoneacrylamide, (meth)acrylamide, N-methylolacrylamide, hydroxymethyl(meth)acrylate, hydroxyethyl(meth)acrylate, 3-chloro-2-hydroxypropyl (meth)acrylate, N,N-dimethylaminoethyl (meth)acrylate, N,N-diethylaminoethyl (meth)acrylate, butadiene, chloroprene and glycidyl(meth)acrylate, to which the crosslinkable monomer is not limited. The copolymerization with this monomer can optionally improve various properties such as water- and oil-repellency and soil releasability; cleaning durability and washing durability of said repellency and releasability; solubility in solvent; hardness; and feeling.

The fluorine-containing polymer such as the fluorine-containing polymer (A) and fluorine-containing polymer(B) preferably has a weight average molecular weight of 2,000 to 1,000,000, for example, 10,000 to 200,000.

Preferably, the amount of the repeat unit (A-I) is from 40 to 89.9% by weight, more preferably from 50 to 79.5% by weight, the amount of the repeat unit (A-II) is from 5 to 50% by weight, more preferably from 10 to 40% by weight, the amount of the repeat unit (A-III) is from 5 to 54.9% by weight, more preferably from 10 to 40% by weight, and the amount of the repeat unit (A-IV) is from 0.1~10% by weight, more preferably 0.5 to 5% by weight, based on the fluorine-containing polymer (A).

Preferably, the amount of the repeat unit (B-I) is from 39 to 94.9% by weight, more preferably from 50 to 89.5% by weight, the amount of the repeat unit (B-II) is from 5 to 60% by weight, more preferably from 10 to 40% by weight, and the amount of the repeat unit (B-III) is from 0.1 to 10% by weight, more preferably from 0.5 to 5% by weight, based on the fluorine-containing polymer (B).

A mixture of the fluorine-containing polymer (A) and the fluorine-containing polymer (B) may be used as the water- and oil-repellent agent. A weight ratio of the fluorine-containing polymer (A) to fluorine-containing polymer (B) in this mixture may be from 1:99 to 99:1, for example, from 10:90 to 90:10.

The fluorine-containing polymer in the present invention can be produced by any polymerization method, and the conditions of the polymerization reaction can be arbitrary selected. The polymerization method includes, for example, solution polymerization and emulsion polymerization. Among them, emulsion polymerization is particularly preferred.

In the solution polymerization, there can be used a method of dissolving a monomer in an organic solvent in the presence of a polymerization initiator, and stirring the mixture with heating at the temperature within the range from 50 to 120° C. for 1 to 10 hours. Examples of the polymerization initiator include azobisisobutyronitrile, benzoyl peroxide, di-tert-butyl peroxide, lauryl peroxide, cumene hydroperoxide, t-butyl peroxypivalate and diisopropyl peroxydicarbonate. The polymerization initiator is used in the amount within the range from 0.01 to 5 parts by weight based on 100 parts by weight of the monomer.

The organic solvent is inert to the monomer and dissolves them, and examples thereof include pentane, hexane, heptane, octane, cyclohexane, benzene, toluene, xylene, petroleum ether, tetrahydrofuran, 1,4-dioxane, methyl ethyl ketone, methyl isobutyl ketone, ethyl acetate, butyl acetate, 1,1,2,2-tetrachloroethane, 1,1,1-trichloroethane, trichloroethylene, perchloroethylene, tetrachlorodifluoroethane and trichlorotrifluoroethane. The organic solvent may be used in the amount within the range from 50 to 1,000 parts by weight based on 100 parts by weight of the monomer.

In the emulsion polymerization, there can be used a method of emulsifying a monomer in water in the presence of a polymerization initiator and an emulsifying agent, replacing by nitrogen, and copolymerizing with stirring at the temperature within the range, for example, from 50 to 80° C. for 1 to 10 hours. As the polymerization initiator, for example, water-soluble initiators (e.g., benzoyl peroxide, lauroyl peroxide, t-butyl perbenzoate, 1-hydroxycyclohexyl hydroperoxide, 3-carboxypropionyl peroxide, acetyl peroxide, azobisisobutylamidine dihydrochloride, azobisisobutyronitrile, sodium peroxide, potassium persulfate and ammonium persulfate) and oil-soluble initiators (e.g., azobisisobutyronitrile, benzoyl peroxide, di-tert-butyl peroxide, lauryl peroxide, cumene hydroperoxide, t-butyl peroxypivalate and diisopropyl peroxydicarbonate) are used. The polymerization initiator is used in the amount within the range from 0.01 to 5 parts by weight based on 100 parts by weight of the monomer.

In order to obtain a copolymer dispersion in water, which is superior in storage stability, it is desirable that the monomers are atomized in water by using an emulsifying device capable of applying a strong shattering energy (e.g., a high-pressure homogenizer and an ultrasonic homogenizer) and then polymerized with using the oil-soluble polymerization initiator. As the emulsifying agent, various emulsifying agents such as an anionic emulsifying agent, a cationic emulsifying agent and a nonionic emulsifying agent can be used in the amount within the range from 0.5 to 10 parts by weight based on 100 parts by weight of the monomers. When the monomers are not completely compatibilized, a compatibilizing agent capable of sufficiently compatibilizing them (e.g., a water-soluble organic solvent and a low-molecular weight monomer) is preferably added to these monomers. By the addition of the compatibilizing agent, the emulsifiability and copolymerizability can be improved.

Examples of the water-soluble organic solvent include acetone, methyl ethyl ketone, ethyl acetate, propylene glycol, dipropylene glycol monomethyl ether, dipropylene glycol, tripropylene glycol and ethanol. The water-soluble organic solvent may be used in the amount within the range from 1 to 50 parts by weight, e.g., from 10 to 40 parts by weight, based on 100 parts by weight of water.

The fluorine-containing low molecular weight compound may have a molecular weight of less than 2,000, for example, from 500 to 1,500 and may be a fluoroalkyl group-containing compound.

The fluorine-containing low molecular weight compound may be, for example, a fluoroalkyl group-containing urethane or a fluoroalkyl group-containing ester.

The fluoroalkyl group-containing urethane can be prepared by reacting (i) a compound having at least two isocyanate groups, with (ii) a fluorine-containing compound having one hydroxyl group, amino group or epoxy group.

Examples of the compound having at least two isocyanate groups (i) are the same as those of the above-mentioned compound having at least two isocyanate groups (a) used for the fluoroalkyl group-containing urethane monomer deriving the fluorine-containing copolymer.

Specific examples of the fluorine-containing compound having one hydroxyl group, amino group or epoxy group (ii) are as follows:

$CF_3CF_2(CF_2CF_2)_nCH_2CH_2OH$ $CF_3CF_2(CF_2CF_2)_nCH_2CH_2NH_2$

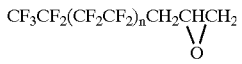

[n is from 2 to 8]

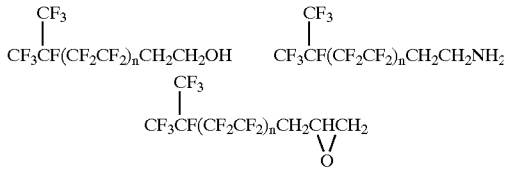

[n is from 2 to 8]

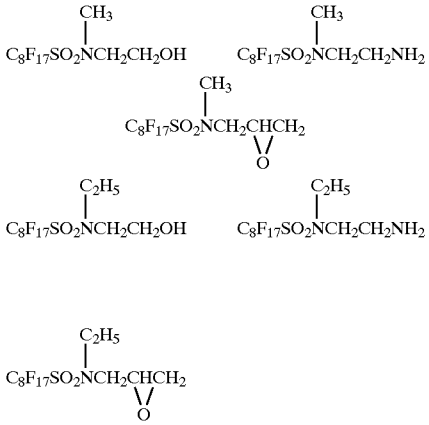

The fluoroalkyl group-containing ester can be prepared by reacting:

(iii) a polybasic carboxylic acid compound, with (ii) a fluorine-containing compound having one hydroxyl group, amino group or epoxy group.

The polybasic carboxylic acid compound is a compound having at least 2, preferably 2 to 4 carboxylic acid groups.

Specific examples of the polybasic carboxylic acid compound are as follows:

HOOC $(CH_2)_n$COOH
[n is 2, 4 or 6]

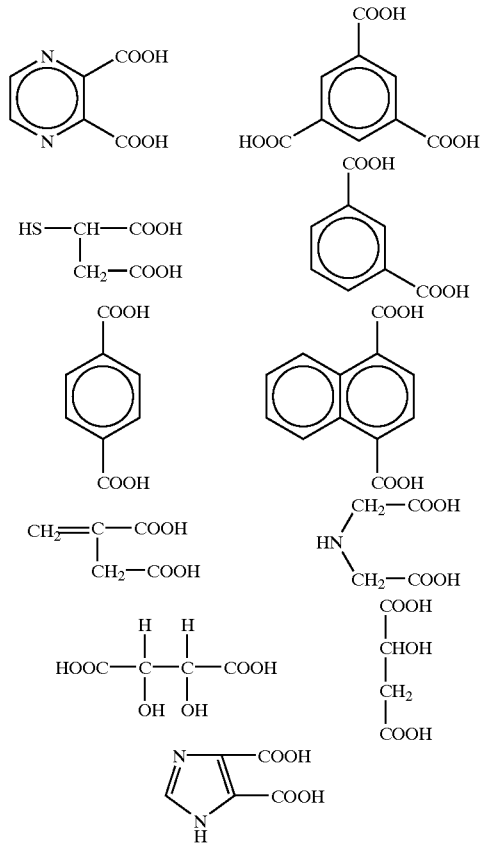

Examples of the fluorine-containing compound having one hydroxyl group, amino group or epoxy group (ii) forming the fluoroalkyl group-containing ester are the same as those of the above-mentioned fluorine-containing compound having one hydroxyl group, amino group or epoxy group (ii) forming the fluoroalkyl group-containing urethane.

The fluorine-containing compound may be the fluorine-containing polymer, the fluorine-containing low molecular weight compound, or a mixture of the fluorine-containing polymer and the fluorine-containing low molecular weight compound.

The amount of the fluorine-containing compound is at most 60% by weight, preferably from 1 to 40% by weight, for example, 1 to 30% by weight, based on the water- and oil-repellent agent. The amount of the emulsifier may be from 0.5 to 15 parts by weight, based on 100 parts by weight of the fluorine-containing compound.

Preferable examples of the stain blocking agent include a phenol/formaldehyde condensation product, an acrylic polymer, and a mixture of a phenol/formaldehyde condensation product with an acrylic polymer. Examples of the phenol/formaldehyde condensation product include a sulfonated phenol resin. Examples of the acrylic polymer include a methacrylic acid-based polymer such as a homopolymer of methacrylic acid, a copolymer of methacrylic acid, e.g., a methacrylic acid/butyl methacrylate copolymer.

The sulfated fatty acid compound may be a sulfated fatty acid, a sulfated fatty acid ester or a salt of sulfated fatty acid ester. Examples of the sulfated fatty acid compound are a sulfated fatty acid triester and a salt thereof, a sulfated fatty acid diester and a salt thereof, and a sulfated fatty acid monoester and a salt thereof.

The fatty acid may be a saturated fatty acid or a unsaturated fatty acid. Examples of the saturated fatty acid incude caprylic acid, capric acid, lauric acid, myristic acid, palmitic acid, stearic acid and hydroxystearic acid. The unsaturated acid is a compound having at least one (particularly, one, two or three) carbon-carbon double bond. Examples of the unsaturated fatty acid include oleic acid, linoleic acid, linolenic acid, ricinoleic acid and erucic acid. The number of carbon atoms of the fatty acid is generally from 4 to 22, for example, from 6 to 20, particularly from 8 to 22.

Examples of an alcohol forming the fatty acid ester include mono- to tetra-hydric alcohol, for example, a $C_5$–$C_{20}$ higher alcohol and glycerol.

Examples of a metal in the salt of fatty acid ester include an alkaline metal such as pottasium and sodium, and an alkaline earth metal such as calcium and magnesium.

The sulfated fatty acid compound can be prepared by sulfating a naturally occurring oil and fat (generally, a fatty acid triester) or wax (generally, a fatty acid monoester) which may be generally a mixture of fatty acids. Examples of the sulfated oil and fat include a sulfated coconut oil , a sulfated palm kernel oil, a sulfated peanut oil, a sulfated olive oil, a sulfated castor oil, a sulfated rapeseed oil and a sulfated tallow oil. Examples of the sulfated wax include a sulfated sperm oil.

The sulfated castor oil may be, for example, a compound of the formula:

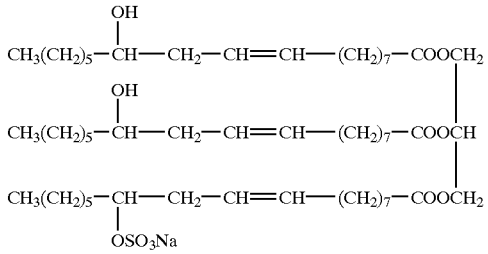

The treatment liquid may contain a salt, particularly a metal salt. When the treatment liquid has a low pH (for example, at most 1.8, particularly at most 1.5), the treatment liquid may not contain the salt. When the treatment liquid has a high pH (for example, more than 1.8, particularly at least 2.0), the treatment liquid preferably contains the salt.

The salt may be, for example, a salt of monovalent or divalent metal. Examples of the salt include LiCl, NaCl, NaBr, NaI, $CH_3COONa$, KCl, CsCl, $Li_2SO_4$, $Na_2SO_4$, $NH_4Cl$, $(NH_4)_2SO_4$, $(CH_3)_4NCl$, $MgCl_2$, $MgSO_4$, $CaCl_2$, $Ca(CH_3COO)2$, $SrCl_2$, $BaCl_2$, $ZnCl_2$, $ZnSO_4$, $FeSO_4$, $CuSO_4$, HCOOLi, HCOOK, HCOONa, $(HCOO)_2Ca$, HCOOCs, $HCOONH_4$, $CH_3COOLi$, $CH_3COOK$, $(HCOO)_2Mg$, $(CH_3COO)_2Mg$, $(CH_3COO)_2Ca$, $(CH_3COO)_2Zn$, $(COOK)_2$ and $(COONa)_2$.

In the step (2) in the method of the present invention, the pH of the treatment liquid is brought to at most 7. The treatment liquid has the pH of at most 7. The pH of the treatment liquid is preferably at most 4, more preferably at most 3, for example, at most 2.5. The pH can be decreased by addition of an acid such as an aqueous solution of citrconic acid and an aqueous solution of sulfamic acid to the treatment liquid.

In the step (3) of the method of the present invention, the treatment liquid is applied to the textile. The water- and oil-repellent agent can be applied to a substrate to be treated (that is, the textile) by a know procedure. The application of the treatment liquid can be conducted by immersion, spraying and coating. Usually, the treatment liquid is diluted with an organic solvent or water, and is adhered to surfaces of the substrate by a well-known procedure such as an immersion coating, a spray coating and a foam coating to a fabric (for example, a carpet cloth), a yarn (for example, a carpet yarn) or an original fiber. If necessary, the treatment liquid is applied together with a suitable crosslinking agent, followed by curing. It is also possible to add mothproofing agents, softeners, antimicrobial agents, flame retardants, antistatic agents, paint fixing agents, crease-proofing agents, etc. to the treatment liquid.

The concentration of the fluorine-containing compound in the treatment liquid may be from 0.02 to 30% by weight, preferably from 0.02 to 10% by weight. The concentration of the stain blocking agent in the treatment liquid may be from 0.05 to 20% by weight, for example, from 0.1 to 10% by weight. The concentration of the sulfated fatty acid in the treatment liquid may be from 0.01 to 20% by weight, for example, from 0.05 to 10% by weight. The concentration of the salt in the treatment liquid may be from at most 10% by weight, for example, from 0.05 to 5% by weight.

In the step (4) of the method of the present invention, the textile is thermally treated. The thermal treatment can be conducted by applying a steam (for example, 80 to 110° C.) to the textile under a normal pressure for e.g., 10 seconds to 30 minutes.

In the step (5) of the method of the present invention, the textile is washed with water and dehydrated. The thermally treated textile is washed with water at least once. Then, in order to remove excess water, the textile is dehydrated by a usual dehydration procedure such as a centrifuging and vacuuming procedure. After the step (5), the textile can be dried.

The substrate to be treated in the present invention is preferably a textile, particularly a carpet. The textile includes various examples. Examples of the textile include animal- or vegetable-origin natural fibers such as cotton, hemp, wool and silk; synthetic fibers such as polyamide, polyester, polyvinyl alcohol, polyacrylonitrile, polyvinyl chloride and polypropylene; semisynthetic fibers such as rayon and acetate; inorganic fibers such as glass fiber, carbon fiber and asbestos fiber; and a mixture of these fibers. The present invention can be suitably used in carpets made of nylon fibers, polypropylene fibers and/or polyester fibers, because the present invention provides excellent resistance to a detergent solution and brushing (mechanical).

The textile may be in any form such as a fiber and a fabric. When the carpet is treated according to the method of the present invention, the carpet may be formed after the fibers or yarns are treated according to the present invention, or the formed carpet may be treated according to the present invention.

EXAMPLES

The following Examples further illustrate the present invention in detail but are not to be construed to limit the scope thereof. The water repellency, oil repellency, stain block (SB) property and yellowing-resistance of the carpets obtained in the Examples and Comparative Example were evaluated.

Test procedures of the water repellency, the oil repellency, the stain block (SB) property and the yellowing-resistance are as follows.

Water Repellency Test

A carpet treated for giving repellency is stored in a thermo-hygrostat having a temperature of 21° C. and a humidity of 65% for at least 4 hours. A test liquid (isopropyl alcohol (IPA), water, and a mixture thereof, as shown in Table 1) which has been also stored at 21° C. is used. The test is conducted in the thermo-hygrostat having a temperature of 21° C. and a humidity of 65%. Droplets of the test liquid in an amount of 50 μL (5 droplets) are softly dropped by a micropipette on the carpet. If 4 or 5 droplets remain on the carpet after standing for 10 seconds, the test liquid passes the test. The water repellency is expressed by a point corresponding to a maximum content of isopropyl alcohol (% by volume) in the test liquid which passes the test. The water repellency is evaluated as twelve levels which are Fail, 0, 1, 2, 3, 4, 5, 6, 7, 8, 9 and 10 in order of a bad level to an excellent level.

TABLE 1

| | Water repellency test liquid (% by volume) | |
|---|---|---|
| Point | Isopropyl alcohol | Water |
| 10 | 100 | 0 |
| 9 | 90 | 10 |
| 8 | 80 | 20 |
| 7 | 70 | 30 |
| 6 | 60 | 40 |
| 5 | 50 | 50 |
| 4 | 40 | 60 |
| 3 | 30 | 70 |
| 2 | 20 | 80 |
| 1 | 10 | 90 |
| 0 | 0 | 100 |
| Fail | Inferior to isopropyl alcohol 0/water 100 | |

Oil Repellency Test

A carpet treated for giving repellency is stored in a thermo-hygrostat having a temperature of 21° C. and a humidity of 65% for at least 4 hours. A test liquid (shown in Table 2) which has been also stored at 21° C. is used. The test is conducted in the thermo-hygrostat having a temperature of 21° C. and a humidity of 65%. Droplets of the test liquid in an amount of 50 μL (5 droplets) are softly dropped by a micropipette on the carpet. If 4 or 5 dropplets remain on the carpet after standing for 30 seconds, the test liquid passes the test. The oil repellency is expressed by a point corresponding to a maximum content of isopropyl alcohol (% by volume) in the test liquid which passes the test. The oil repellency is evaluated as nine levels which are Fail, 0, 1, 2, 3, 4, 5, 6, 7 and 8 in order of a bad level to an excellent level.

TABLE 2

| | Oil repellency test | |
|---|---|---|
| Point | Test liquid | Surface tension (dyne/cm, 25° C.) |
| 8 | n-Heptane | 20.0 |
| 7 | n-Octane | 21.8 |
| 6 | n-Decane | 23.5 |
| 5 | n-Dodecane | 25.0 |
| 4 | n-Tetradecane | 26.7 |
| 3 | n-Hexadecane | 27.3 |
| 2 | Mixture liquid of n-Hexadecane 35/nujol 65 | 29.6 |
| 1 | Nujol | 31.2 |
| Fail | Inferior to 1 | — |

Stain Block (SB) Property Test

The test is according to AATCC Test Method 175-1993.

A carpet treated for giving repellency is stored in a thermo-hygrostat having a temperature of 21° C. and a humidity of 65% for 24 hours. 100 mg of Red 40 (a red dye) is dissolved in 1 L of water and pH of an aqueous Red 40 solution is adjusted to 2.8 by adding citric acid. 20 mL of the aqueous Red solution is weighed in a cup. After a ring for the SB test is placed on a middle of the carpet, 20 mL of the aqueous Red solution is poured into the ring. The cup was moved up and down five times in the ring. A carpet is stored in a thermo-hygrostat having a temperature of 21° C. and a humidity of 65% for 24 hours. Then, the carpet is sufficiently washed with water, centrifugally dehydrated and dried at 100° C. for 15 minutes. The appearance of the carpet is visually evaluated by an AATCC Red 40 stain scale. The SB property is evaluated as ten levels of 1, 2, 3, 4, 5, 6, 7, 8, 9 and 10 which are from a fully dyed red state to a never dyed state.

Yellowing (Discoloration) Test

The test is according to AATCC Test Method 164-1992.

A carpet (6 cm×6 cm) treated for giving repellency and a control ribbon No. 1 are hung and stood for 4 cycles in a test chamber (manufactured by Yamasaki Seiki Kenkyusho Co., Ltd.) having a humidity of 87.5%, a temperature of 40° C. and 500 pphm of $NO_2$. One cycle has been previously determined by measuring the time giving 16.5±1.5 of dE of the control ribbon. After the completion of 4 cycles, the samples are removed from the chamber. The yellowing of the carpet is visually evaluated by an AATCC gray scale. The yellowing visual determination is evaluated as five levels of 1, 2, 3, 4 and 5 which are from a fully yellowing state to a never discolored state.

Preparative Example 1

Preparation of a Fluorine-containing Water- and Oil-repellent Agent (a)

$CH_2{=}CHCOO(CH_2)_2(CF_2CF_2)_nCF_2CF_3$ (a mixture of compounds wherein n is 3, 4 and 5 in a weight ratio of 5:3:1) (FA), stearyl acrylate (StA), N-methylolacrylamide (N-MAM), 3-chloro-2-hydroxypropyl methacrylate (TOPOLEN M), deionized water, n-laurylmercaptan (LSH, a chain transfer agent), dioctadecyldimethyl ammonium chloride (CATION 2ABT, a cationic emulsifier), polyoxyethylenealkylphenyl ether (EMULGEN 985, a nonionic emulsifier), polyoxyethylene-alkylphenyl ether (NONION HS-208, a nonionic emulsifier), sorbitan monopalmitate (NONION PP-40R, a nonionic emulsifier) and dipropyleneglycol monomethyl ether (DPM) were mixed in the amounts shown in Table 3 to give a mixture liquid.

This mixture liquid was heated at 60° C. and emulsified by a high pressure homogenizer. The resultant emulsion was charged into a 1 L autoclave and subjected to a nitrogen gas replacement to remove a dissolved oxygen. Vinyl chloride having a purity of 99% (VC1) was charged in the amount shown in Table 3 and then an initiator, 2,2',-azobis(2-amidinopropane)dichloride (V-50) was charged in the amount shown in Table 3. With stirring, the copolymerization reaction was conducted for 60° C. at 8 hours to give a vinyl chloride-containing copolymer emulsion, which was diluted with water to give an emulsion having a solid content of 30% by weight.

Preparative Example 2

Preparation of a Fluorine-containing Water- and Oil-repellent Agent (b)

$CH_2{=}CHCOO(CH_2)_2(CF_2CF_2)_nCF_2CF_3$ (a mixture of compounds wherein n is 3, 4 and 5 in a weight ratio of 5:3:1)(FA), stearyl acrylate (StA), 2-hydroxyethyl methacrylate (2EHA), glycidyl methacrylate (BLENMER G), N-methylolacrylamide (N-MAM), 3-chloro-2-hydroxypropyl methacrylate (TOPOLEN M), deionized water, n-laurylmercaptan (LSH), polyoxyethylenealkylphenyl ether sulfate ammonium (HITENOL N-17, an anionic emulsifier), polyoxyethylenealkylphenyl ether (NONION HS-220, a nonionic emulsifier), sorbitan monolaurate (LP-20R, a nonionic emulsifier) and dipropylene glycol monomethylether (DPM) were mixed in the amounts shown in Table 3 to give a mixture liquid.

This mixture liquid was heated at 60° C. and emulsified by a high pressure homogenizer. The resultant emulsion was charged into a 1 L autoclave and subjected to a nitrogen gas replacement to remove a dissolved oxygen. Then, an initiator, ammonium persulfate (APS) was charged in the amount shown in Table 3. With stirring, the copolymerization reaction was conducted for 60° C. at 8 hours to give a fluorine-containing copolymer emulsion, which was diluted with water to give an emulsion having a solid content of 30% by weight.

TABLE 3

Composition ratio of charged monomers (weight(g))

| | Pre. Ex. 1 | Pre. Ex. 2 |
|---|---|---|
| SFA | 90.4 | 79.2 |
| STA | 6.0 | 19.1 |
| VCl(vinyl chloride) | 14.7 | — |
| 2EHA | — | 19.1 |
| BLENMER G | — | 2.6 |
| N-MAM | 2.4 | 3.0 |
| TOPOLEN M | 0.6 | 1.3 |
| LSH | 0.8 | 0.24 |
| Ammonium persulfate | — | 0.56 |
| 2,2'-Azobis(2-amidinopropane) dichloride | 0.76 | |
| NONION PP-40R | 1.92 | — |
| NONION HS-208 | 4.20 | — |
| NONION HS-220 | — | 1.72 |
| LP-20R | — | 2.16 |
| EMULGEN 985 | 1.92 | — |
| CTION 2ABT | 2.0 | — |
| HITENOL N-17 | — | 5.20 |
| Pure water | 236 | 244 |

Preparative Example 3

The fluorine-containing water- and oil-repellent agent (a) prepared in Preparative Example 1 (which is a fluorine-containing water- and oil-repellent agent containing vinyl chloride) and the fluorine-containing water- and oil-repellent agent (b) prepared in Preparative Example 2 (which is a fluorine-containing water- and oil-repellent agent free from vinyl chloride) in a solid content weight ratio of 8 to 2 were mixed to give a fluorine-containing polymer emulsion mixture.

Comparative Example 1

0.9 Grams of the fluorine-containing polymer emulsion mixture prepared in Preparative Example 3 and 5 g of a stain blocking agent (a mixture of a phenol/formaldehyde condensation product and polymethacrylic acid in a weight ratio of 50:50) (hereinafter referred to as "SB agent") were mixed, and diluted with water to give a total amount of 1,000 g. A pH of the mixture was adjusted to 2.5 by adding a 10% aqueous solution of sulfamic acid to give a treatment liquid.

A carpet (20 cm×20 cm, nylon 6, cut piled, density: 32 oz/yd$^2$) which was washed with water and squeezed to give a WPU of about 25% (WPU: wet pick up) (WPU is 25% when 25 g of liquid is contained in 100 g of carpet.) was immersed in the treatment liquid for 30 seconds. Then, the carpet was squeezed to give the WPU (wet pick up) of 300%. Then, a normal pressure steamer treatment (a temperature of 100° C. to 107° C.) was conducted for 90 seconds under the state that a pile surface of the carpet is upward. Then, the carpet was lightly rinsed with 2 L of water, and centrifugally dehydrated to give the WPU of about 25%. Finally, the carpet was thermally cured at 110° C. for ten minutes.

Then, a water repellency test, an oil repellency test, a stain block test and a yellowing test were conducted. The results are shown in Table 4.

Comparative Example 2

0.9 Grams of the fluorine-containing polymer emulsion mixture prepared in Preparative Example 3, 5 g of a SB agent, and 100 g of a 10% aqueous solution of potassium formate were mixed and diluted with water to give a total amount of 1,000 g. A pH of the mixture was adjusted to 2.5 by adding a 10% aqueous solution of sulfamic acid to give a treatment liquid. The carpet was treated to have repellency in the same manner as in Comparative Example 1.

Then, a water repellency test, an oil repellency test, a stain block test and a yellowing test were conducted. The results are shown in Table 4.

Example 1

0.9 Grams of the fluorine-containing polymer emulsion mixture prepared in Preparative Example 3, 5 g of a SB agent, and 100 g of a 10% aqueous solution of sodium acetate were mixed and diluted with water to give a total amount of 1,000 g. A pH of the mixture was adjusted to 2.5 by adding a 10% aqueous solution of sulfamic acid to give a treatment liquid. The carpet was treated to have repellency in the same manner as in Comparative Example 1.

Then, a water repellency test, an oil repellency test, a stain block test and a yellowing test were conducted. The results are shown in Table 4.

Example 2

0.9 Grams of the fluorine-containing polymer emulsion mixture prepared in Preparative Example 3, 5 g of a SB agent, 100 g of a 10% aqueous solution of sodium acetate and 4 g or 8 g of sulfated castor oil were mixed and diluted with water to give a total amount of 1,000 g. A pH of the mixture was adjusted to 2.5 by adding a 10% aqueous solution of sulfamic acid to give a treatment liquid. The carpet was treated to have repellency in the same manner as in Comparative Example 1.

Then, a water repellency test, an oil repellency test, a stain block test and a yellowing test were conducted. The results are shown in Table 4.

TABLE 4

| | Added salt | | Sulfated castor | | | | |
|---|---|---|---|---|---|---|---|
| | Type | Amount [g/L] | oil [g/L] | Water repellency | Oil repellency | SB property | Yellowing property |
| Com. Example 1 | — | 0 | 0 | Fail | Fail | 2 | 2 |
| Com. Example 2 | Potassium formate | 10 | 0 | 8 | 3 | 7 | 2 |
| Example 1 | Potassium formate | 10 | 4 | 8 | 6 | 9 | 3 |
| | Potassium formate | 10 | 8 | 9 | 7 | 9 | 4 |
| Com. Example 3 | Sodium acetate | 10 | 0 | 8 | 4 | 6 | 2 |
| Example 2 | Sodium acetate | 10 | 4 | 9 | 6 | 7 | 3 |
| | Sodium acetate | 10 | 8 | 9 | 6 | 7 | 4 |

agent, 100 g of a 10% aqueous solution of potassium formate and 4 g or 8 g of sulfated castor oil were mixed and diluted with water to give a total amount of 1,000 g. A pH of the mixture was adjusted to 2.5 by adding a 10% aqueous solution of sulfamic acid to give a treatment liquid. The carpet was treated to have repellency in the same manner as in Comparative Example 1.

Then, a water repellency test, an oil repellency test, a stain block test and a yellowing test were conducted. The results are shown in Table 4.

Comparative Example 3

0.9 Grams of the fluorine-containing polymer emulsion mixture prepared in Preparative Example 3, 5 g of a SB Comparative Example 4

0.9 Grams of the fluorine-containing polymer emulsion mixture prepared in Preparative Example 3 and 5 g of a stain blocking agent (a mixture of a phenol/formaldehyde condensation product and polymethacrylic acid in a weight ratio of 50:50) (hereinafter referred to as "SB agent") were mixed, and diluted with water to give a total amount of 1,000 g. A pH of the mixture was adjusted to 1.5 by adding a 10% aqueous solution of sulfamic acid to give a treatment liquid.

A carpet (20 cm×20 cm, nylon 6, cut piled, density: 32 oz/yd$^2$) which was washed with water and squeezed to give a WPU of about 25% (WPU: wet pick up) (WPU is 25% when 25 g of liquid is contained in 100 g of carpet.) was immersed in the treatment liquid for 30 seconds. Then, the carpet was squeezed to give the WPU (wet pick up) of 300%. Then, a normal pressure steamer treatment (a temperature of 100° C. to 107° C.) was conducted for 90 seconds under the state that a pile surface of the carpet is upward. Then, the carpet was lightly rinsed with 2 L of water, and centrifugally dehydrated to give the WPU of about 25%. Finally, the carpet was thermally cured at 110° C. for ten minutes.

Then, a water repellency test, an oil repellency test, a stain block test and a yellowing test were conducted. The results are shown in Table 5.

Example 3

0.9 Grams of the fluorine-containing polymer emulsion mixture prepared in Preparative Example 3, 5 g of a SB agent and 4 g of sulfated castor oil were mixed and diluted with water to give a total amount of 1,000 g. A pH of the mixture was adjusted to 1.5 by adding a 10% aqueous solution of sulfamic acid to give a treatment liquid. The carpet was treated to have repellency in the same manner as in Comparative Example 4.

Then, a water repellency test, an oil repellency test, a stain block test and a yellowing test were conducted. The results are shown in Table 5.

TABLE 5

| | Sulfated castor oil [g/L] | Water repellency | Oil repellency | SB property | Yellowing property |
|---|---|---|---|---|---|
| Com. Example 4 | 0 | 6 | 3 | 6 | 2 |
| Example 3 | 4 | 7 | 5 | 7 | 3 |

EFFECTS OF THE INVENTION

The present invention provides a textile with excellent water repellency, oil repellency, stain block property and yellowing-resistance.

What is claimed is:

1. A method of preparing a treated textile, comprising steps of:

(1) preparing a treatment liquid comprising a water- and oil-repellent agent and a stain blocking agent, (2) adjusting pH of the treatment liquid to at most 7, (3) applying the treatment liquid to the textile, (4) treating the textile with steam, and (5) washing the textile with water and dehydrating the textile, wherein the water- and oil-repellent agent comprises at least one fluorine-containing compound selected from the group consisting of a fluorine-containing polymer and a fluorine-containing low molecular weight compound, and the treatment liquid contains a sulfated fatty acid compound.

2. The method according to claim 1, wherein the sulfated fatty acid compound is selected from the group consisting of a sulfated fatty acid triester and a salt thereof, a sulfated fatty acid diester and a salt thereof, and a sulfated fatty acid monoester and a salt thereof.

3. The method according to claim 1, wherein the fluorine-containing polymer comprises a repeat unit derived from a monomer having a fluoroalkyl group.

4. The method according to claim 1, wherein the fluorine-containing polymer is (A) a fluorine-containing polymer which comprises (A-I) a repeat unit derived from a monomer having a fluoroalkyl group, and (A-II) a repeat unit derived from vinyl chloride and/or vinylidene chloride.

5. The method according to claim 4, wherein the fluorine-containing polymer (A) comprises (A-I) a repeat unit derived from a monomer having a fluoroalkyl group, (A-II) a repeat unit derived from vinyl chloride and/or vinylidene chloride, (A-III) a repeat unit derived from a fluorine-free monomer, and (A-IV) a repeat unit derived from a crosslinkable monomer.

6. The method according to claim 1, wherein the fluorine-containing polymer is (B) a fluorine-containing polymer which comprises (B-I) a repeat unit derived from a monomer having a fluoroalkyl group, and which does not comprise a repeat unit derived from vinyl chloride and/or vinylidene chloride.

7. The method according to claim 1, wherein the fluorine-containing polymer is a mixture of (A) a fluorine-containing polymer comprising:

(A-I) a repeat unit derived from a monomer having a fluoroalkyl group, and (A-II) a repeat unit derived from vinyl chloride and/or vinylidene chloride, with (B) a fluorine-containing polymer which comprises (B-I) a repeat unit derived from a monomer having a fluoroalkyl group, and which does not comprise a repeat unit derived from vinyl chloride and/or vinylidene chloride.

8. The method according to claim 1, wherein the stain blocking agent is a phenol/formaldehyde condensation product, an acrylic polymer, or a mixture of a phenol/formaldehyde condensation product with an acrylic polymer.

9. The method according to claim 1, wherein the pH of the treatment liquid is adjusted to at most 3 in the step (2).

10. A textile obtained by the method according to claim 1.

11. A carpet obtained by the method according to claim 1.

12. The carpet according to claim 11, wherein the carpet comprises a nylon fiber, a propylene fiber and/or a polyester fiber.

13. A treatment liquid usable in a method of preparing a treated textile, comprising steps of:

(1) preparing a treatment liquid comprising a water- and oil-repellent agent and a stain blocking agent, (2) adjusting pH of the treatment liquid to at most 7, (3) applying the treatment liquid to the textile, (4) treating the textile with steam, and (5) washing the textile with water and dehydrating the textile, wherein the water- and oil-repellent agent comprises at least one fluorine-containing compound selected from the group consisting of a fluorine-containing polymer and a fluorine-containing low molecular weight compound, and the treatment liquid contains a sulfated fatty acid compound.

* * * * *